United States Patent [19]

Ben-Dor et al.

[11] 4,273,345

[45] Jun. 16, 1981

[54] ROLLER SKATE

[76] Inventors: Effraim Ben-Dor, P.O. Box 33372, Tel-Aviv, Israel; Jerome H. Lemelson, 85 Rector St., Metuchen, N.J. 08840

[21] Appl. No.: 948,029

[22] Filed: Oct. 2, 1978

[51] Int. Cl.[3] ..... A63C 17/06; A63C 17/14

[52] U.S. Cl. ..... 280/11.2; 280/11.22; 301/5.7

[58] Field of Search ..... 280/11.22, 7.13, 11.2, 280/11.12, 11.23, 11.1 R, 11.1 BT, 11.19, 11.27; 301/5.3, 5.7

[56] References Cited

U.S. PATENT DOCUMENTS 3,756,614 9/1973 Grubin ..... 280/11.22

*Primary Examiner*—Randolph A. Reese
*Assistant Examiner*—Milton L. Smith

[57] ABSTRACT

Roller skates which utilize a single row of narrow wheels to support each skate include housings in a blade-like support for the skate wheels. A friction plate or bar is disposed along the side of the support and is dragged along the skating surface to stop movement of the skate. A plasticly deformable pivot is mounted at each end of the blade-like support to permit spinning movement thereon.

5 Claims, 17 Drawing Figures

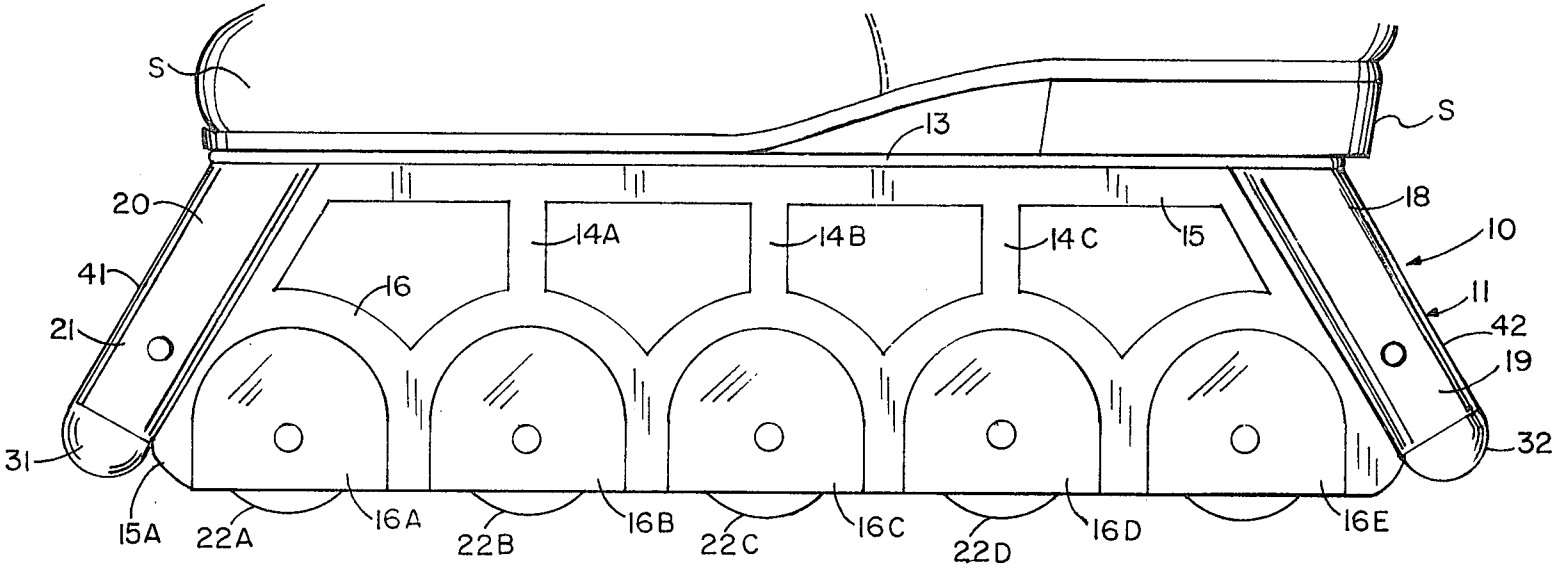
FIG. 1
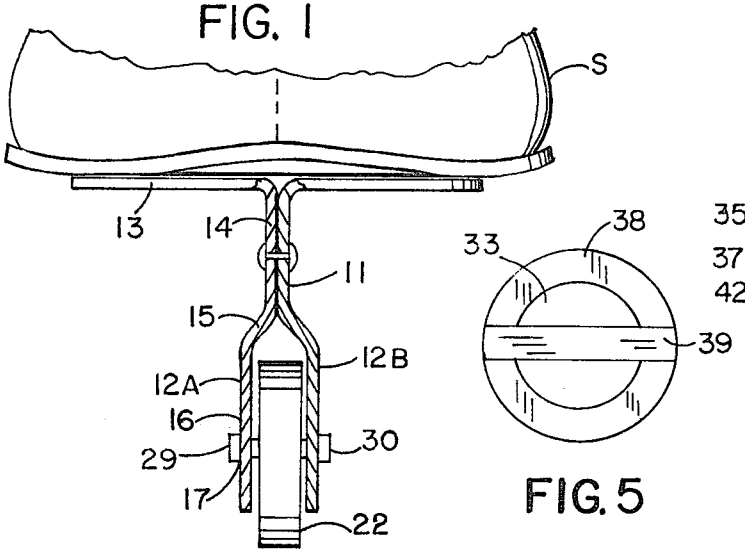
FIG. 2
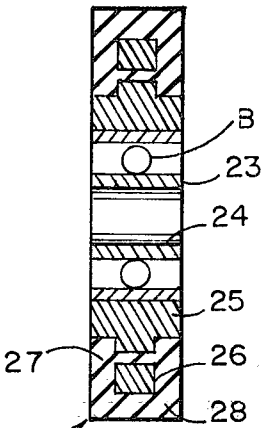
FIG. 3
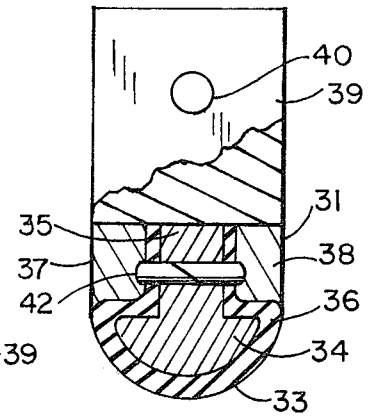
FIG. 4
FIG. 5

ROLLER SKATE

SUMMARY OF THE INVENTION

This invention relates to roller skates, and in particular to a skate so constructed and designed as to require substantially the same skill, body balance and function as an ice skate. The skate is also constructed to permit the user to perform in a manner similar to performance on ice skates including the performance of such acrobatics as reverse skating, turning or twirling on one foot, and a sliding movement in a lateral direction of the blade of the skate for effecting slowing down or stopping the movement of the skater.

A variety of constructions and configurations in single row wheel supported skates have been proposed and patented, such as those disclosed in U.S. Pats. 3,756,614; 3,900,203; 3,387,852; 1,868,548; 2,048,916; 2,644,692; 1,835,446; 1,728,692 and 938,168.

However the skates disclosed in such patents as well as others of the prior art which employ a single row of wheels on each skate for supporting the skater have a number of shortcomings and disadvantages which limit their operation and performance thereon. For example, substantial difficulties are experienced in attempting to quickly slow down and stop on such skates. Also many figure skating functions which are easily performable on ice skates may not be performed with such single-row roller skates. Improvements in such single-row roller skates are provided in the instant invention which will permit a skater to perform most, if not all of the figure and fancy skating functions which may be performed on ice skates. Furthermore, an improved means is provided to permit the skater to easily slow down and stop thereby enhancing skating safety and providing greater control while performing both conventional and figure skating functions.

Accordingly it is a primary object of this invention to provide a new and improved roller skate.

Another object is to provide a roller skate on which a skate may perform most of the functions which have heretofore been performable with ice skates.

Another object is to provide new and improved constructions in roller skates permitting the skater to simulate ice skating operations and functions such as spins, spirals, free turns, brackets, rockers, loops and other forms of free skating performance.

Another object is to provide a roller skate having a single row of small wheels for support and movement across a surface and a simple braking means to permit the skater to easily slow down and stop in a manner quite similar to slowing down and stopping on ice skates.

Another object is to provide a roller skate having narrow wheels which are plastically deformable permitting such wheels to be utilized on plastic and wooden flooring without damaging or destroying same.

Another object is to provide new and improved structures in composite plastic wheels for use in roller skates.

Another object is to provide improved structures in skate blade supports for wheels or rollers.

With the above and such other objects in view as may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

In the drawings:

FIG. 1 is a side view of a skate assembly and a portion of the shoe to which it is attached, employing a single row of five wheels which are narrow enough to permit simulation of ice skating on a pair of such skates.

FIG. 2 is an end view in partial cross section of the skate assembly of FIG. 1.

FIG. 3 is a cross sectional view of one of the wheels employed in the skate assembly of FIG. 1 as well as the other embodiments of the invention defined herein.

FIG. 4 is a side view with parts sectioned for clarity of a pivot assembly for use with the skate of FIG. 1.

FIG. 5 is a plan view of the assembly of FIG. 4.

Figure 6:
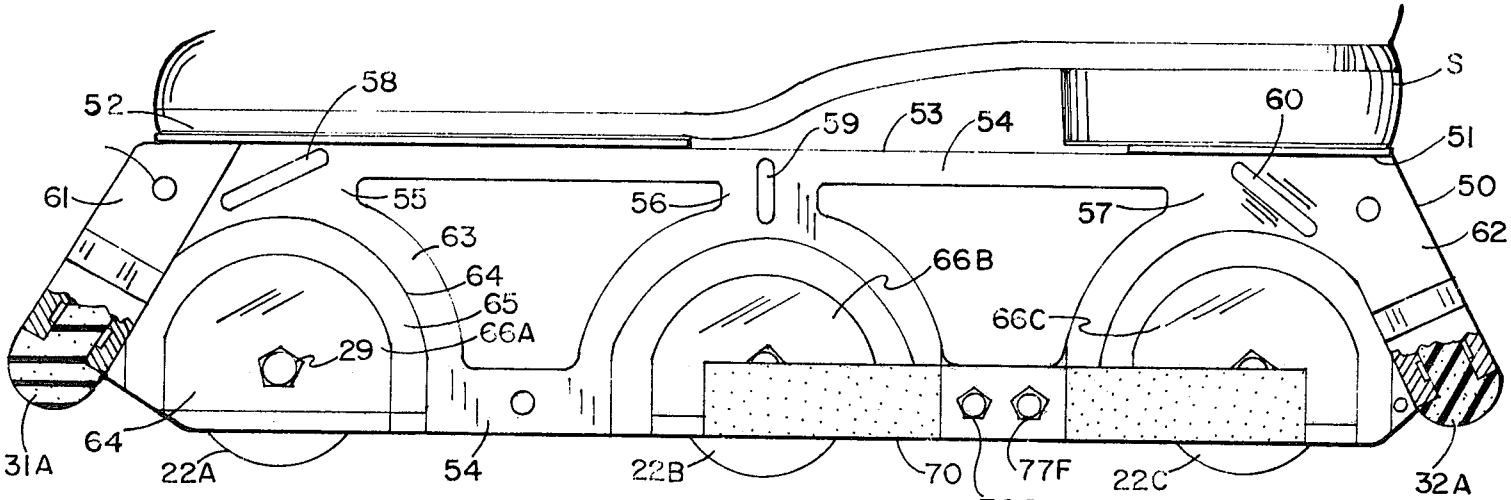
FIG. 6 is a side view of a modified skate assembly of the type shown in FIGS. 1 and 2.
Figure 6A:
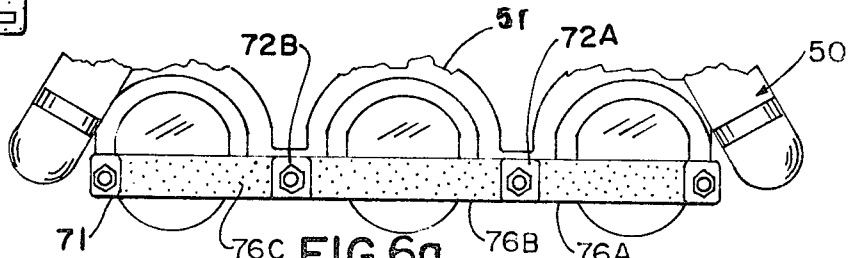

FIG. 6*a* is a partial side view of a modified form of the skate assembly illustrated in FIG. 6.

Figure 7:
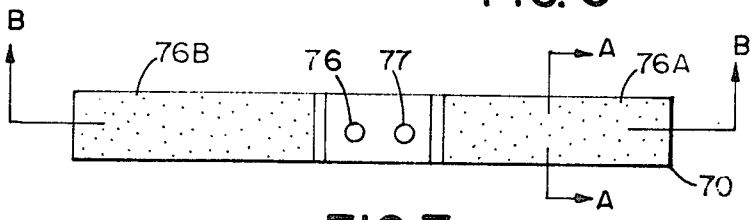

FIG. 7 is a side view of a braking member utilized in the skate assembly of FIG. 6.

Figure 8:
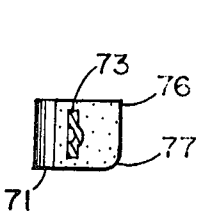

FIG. 8 is an end view of FIG. 7.

Figure 9:
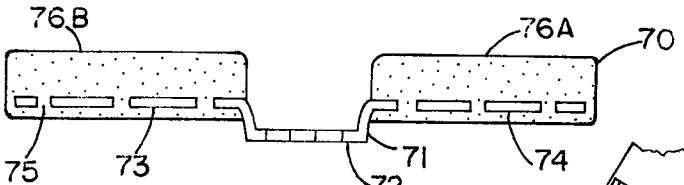

FIG. 9 is a plan view of the device of FIGS. 7 and 8.

Figure 10:
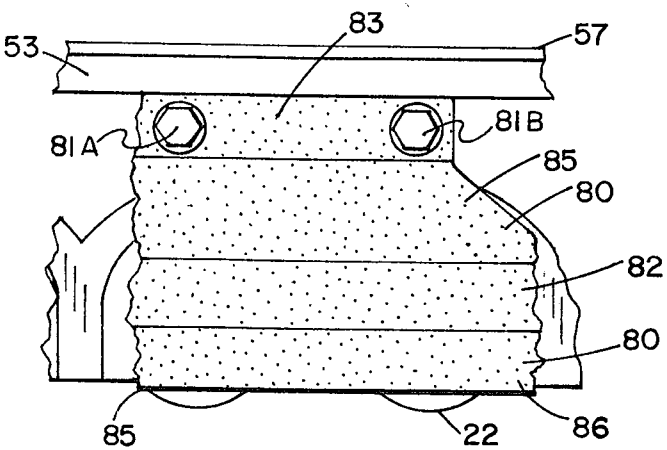
Figure 12:
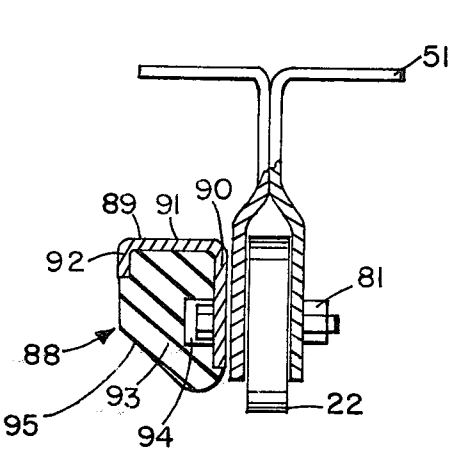
Figure 13:
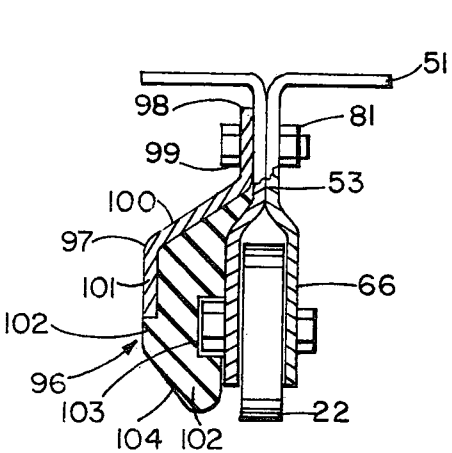
Figure 11:
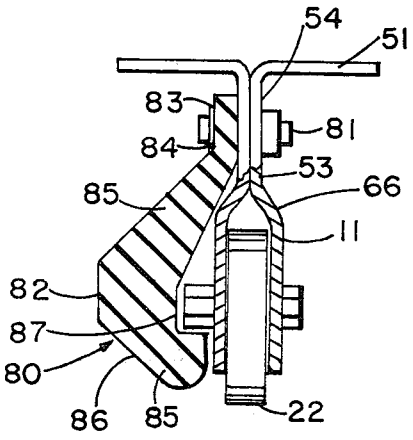
Figure 14:
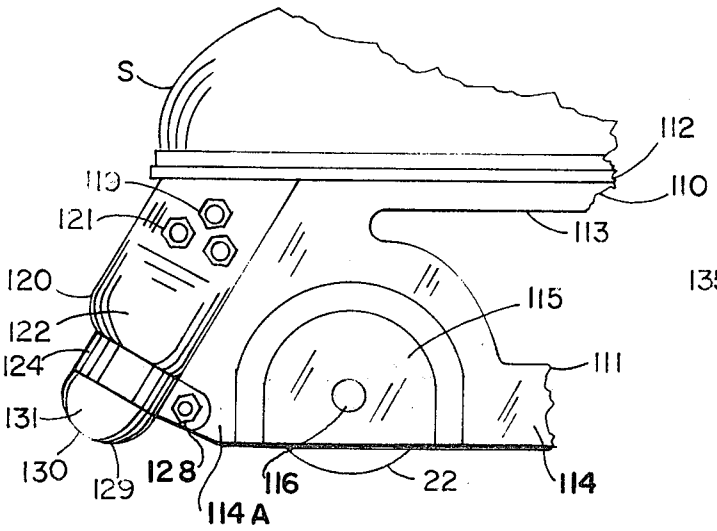

FIG. 10 is a side view with parts broken away of a skate assembly with a modified form of braking means; FIG. 11 is an end view of FIG. 10; FIGS. 12 and 13 are end views in cross section of a modified forms of skate assemblies and braking means;

FIG. 14 is a partial side view of the front end portion of a skate assembly having a modified form of toe braking device.

Figure 15:
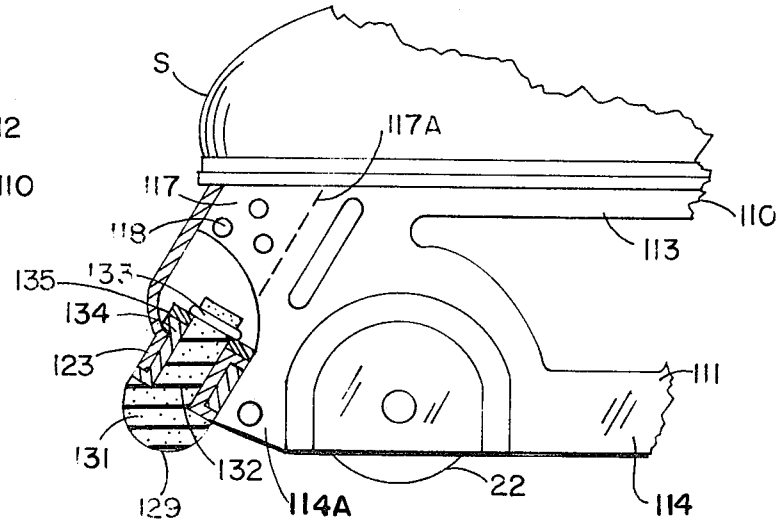
Figure 16:
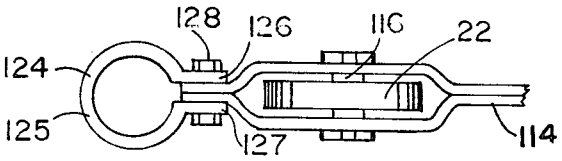

FIG. 15 is a partial side view of the skate assembly of FIG. 14 with portions thereof eliminated and broken away for clarity and, FIG. 16 is a partial bottom view of the forward end of the skate assembly of FIGS. 14 and 15.

FIGS. 1–5 illustrate details of a first form of the invention in the form of a roller skate assembly 10 formed of sheet metal components defining a blade-like assembly 11 supporting a plurality of wheels 22, which are illustrated in FIG. 1 as five in number. The assembly 11 is shown formed of two sheet metal stampings which are illustrated in FIG. 2 and are denoted 12A and 12B, each of the stampings having a respective flange portion 13 and substantially flat vertically extending portions 14, three of which are shown in FIG. 1 and are denoted 14A, 14B and 14C. Such flat portions 14 are, as illustrated in FIG. 2, in abutment with each other and may be riveted or spot welded together, together with other abutting portions of the stampings, to form a blade-like assembly containing wheel cowls or pants formed thereof and denoted 16A, 16B, 16C, 16D and 16E in FIG. 1.

As illustrated in FIG. 2, each of the wheel pants or cowls is formed of an outwardly extending extension 15 of the vertically extending portion 14 of the stamping and a downwardly extending flat portion 16 thereof which forms one side wall of the cowl or pant which supports the wheel 22. Notations 29 and 30 refer respectively to a heavy pin or machine screw and a nut turned on the threaded end of the former. Such screw may extend through holes 17 stamped in the side walls 16 of the cowlings, which support same in bearing.

As illustrated in FIG. 3, each of the wheels 22 is formed of a ball or roller bearing 23 having an inner bearing surface 24 through which the shank of the pin or screw 29 extends to support the bearing and wheel.

The wheel itself is actually formed of an inner wheel portion 25 which may be cast or molded against the outside surface of the outer wall of the bearing 23 and which has a reduced thickness peripheral portion 26 against and around which peripheral portion and abutting the stepped portions of the central portion of the bearing 25 is a peripheral wheel portion 27 having a peripheral layer or stratum 28 located beyond the outer rim of the outer portion 26 of the inner wheel portion 25.

The inner wheel portion 25 may be made of a suitable engineering plastic material, such as polycarbonate resin while the outer wall portion 28 of the wheel may be made of a plastic resin which may be cast or molded in situ against the inner wheel portion 25 and which has a greater resistance to wear than the resistance to wear of the material comprising the inner portion 25.

Located at the rear and front ends of the skate blade assembly 11 are shaped portions 19 and 21 of the stampings which form respective tubular housings for respective assemblies, one of which is shown in FIG. 4 and both of which serve to permit the performance of acrobatic and other functions on the skate 10 by spinning movement on the tips of the assemblies. Pivotal support of the skate and skater is provided on a dome shaped head or end portion 33 of an assembly 31 formed of a core 34 of rigid plastic and a coating or covering 36 of a wear resistent resin such as a polyurethane or other rubber-like resin which is injection molded against the core 34. A shank 35 of the core 34 extends through a collar or bushing 37 which supports the shank in rotation at the end of a flat sided rectangular blade 39 which is inserted into specially shaped recepticle means formed within or assembled inside of the tubular formation 21 at the front end of the blade assembly 11. A split ring 42 rotatably supports shank 35 in the collar 37 so that when the end portion 33 of the assembly 31 is engaged against a floor surface and the wearer thereof spins on his skate, such pivotal movement will be effected at the end of the front of the skate assembly.

FIG. 6 illustrates a modified form of the invention shown in FIGS. 1 and 2 wherein a braking means is provided to permit the skater to slow down or stop his forward or reverse movement along a surface, such as a wooden floor or plastic surface. The skate assembly 50 comprises a blade-like portion 53 which is fastened respectively to the heel and sole of a shoe S by means of laterally extending flanges or plates denoted 51 and 52. The assembly 53 is composed of a narrow upper section 54 which is joined to the flange sections 51 and 52 and extends downwardly along respective front, central and rear portions 55, 56 and 57 thereof to three housings denoted 66A, 66B and 66C which are formed of material extensions of the sheet metal or plastic forming the portions 55, 56 and 57. Notations 58, 59 and 60 refer to respective ribbed portions of the sheet or sheet-like material forming the blade-like assembly 53 for stiffening same. Notation 61 refers to a tubular formation secured to or extending from the forward end of the assembly 53 while notation 62 refers to a somewhat similar tubular formation extending from the rear end of the assembly 53. Three wheels 22A, 22B and 22C constructed as shown in FIG. 3, are supported within the respective front, center and rear wheel housings, each of which housings has tapered side walls 65 which are joined to the flat skirt portions 63 of the blade assembly 53. Pins or screw fasteners 29 rotatably support the ball bearings 23 of the wheels on the side walls of the wheel housings.

The view illustrated in FIG. 6 is that of the inner side of the right shoe supporting the skate assembly 50. Assembled along the lower rear portion of the side wall of the blade assembly 53 thereof is a second assembly 70 formed of two braking members 76A and 76B which are secured to a metal strip 71 having a central portion 72 extending to respective end flange portions 73 and 74. Each of the flange portions 73 and 74 has a plurality of holes 75 extending therethrough and the braking members 76A and 76B are respectively bonded to or molded over and around the flange portions 73 and 74 and have the material thereof extending through the holes 75 in the flange portions to maintain the braking members securely fastened thereto.

The braking members 76A and 76B are both illustrated as being of substantially rectangular parallelepiped shape with respective rounded lower outer edging 77.

When the foot of the person wearing the skate assembly 50 is pivoted or extended such that it is at an angle to the surface on which the person is skating, the braking members 76A and 76B may be made to bear against the skating surface and to be dragged thereagainst to the exclusion of the wheels of the skate so that sufficient friction is generated between the contacting surfaces of the braking members and the surface on which the person is skating to slow down and eventually stop the forward movement of the skater. The braking members 76A and 76B are preferably made of a suitable relatively high coefficient friction material, which will not scratch or otherwise mar the skating surface against which they are brought. Suitable plastic resins of which the braking members 76A and 76B may be molded include polyurethane, ethylene, vinyl, acetate, polybutadiene styrene, butyl, rubber.

Notations 76 and 77 refer to two holes extending through the central portion 72 of the assembly 70 which may be utilized to fasten the assembly to one or more of the portions 54 joining the front, central and rear wheel housings 66 together while notation 76F and 77F refer to fasteners extending through the holes 76 and 77 and respective holes in the portions 54A of the lower portion of the skate blade assembly 53.

Various modifications to the braking pad assembly 70 shown in FIGS. 7 to 9 may be provided and include, in addition to the provision of a plurality of separate molded elastomeric pads or bars attached to a blade-like support which is secured with fasteners to the side of the base or blade-like portion of the skate assembly, a single strip or bar of frictional plastic resin which may extend along substantially the entire length of the base, at least to a degree whereby no portion of the metal comprising the blade-like support may engage and scrape against the skating surface when the foot of the skater is angularly tilted to effect slowing down or stopping.

In FIG. 6*a* is shown a modified form of the invention illustrated in FIGS. 6–9 wherein braking means for the skate extends substantially the entire length of the lower portion of the blade-like assembly so as to provide protection for the surface on which skating is effected from scratching or wear due to any forward portion of the skate blade-like assembly engaging said surface. Three lengths of braking members 76A,76B and 76C made of one of the described materials are secured to a long strip 71 of supporting metal formed at two portions of its length, with indentations 72A and 72B which are secured with fasteners to respective portions of the blade-like assembly.

FIGS. 10–13 illustrate a number of variations in the construction of the described braking member or members. In FIGS. 10 and 11, the braking unit 80 is a single injection molding 82 having a central portion having an upper flange portion 83 containing a plurality of holes 84 molded or otherwise formed therein through which holes extend machine screw fasteners 81 which are secured to the upper portion of the main skate frame 53 by means of machine nuts to thereby hold the molding in place against that side of the skate blade assembly which the user will apply against the floor or skating surface to brake or decelerate.

The molding 82 has a tapered lower end 85 with an outer surface 86 adapted to engage the surface of a wooden floor or plastic covering on which skating occurs and to frictionally decelerate or stop movement of the skater by means of a skate dragging action.

The material of which the braking member or drag plate 80 is molded may comprise a low or medium durometer rubber-like resin such as polynorbornene commercially known as norsorex produced by the American Cyanamide Company of Bound Brook, New Jersey or any other suitable rubber-like resin which will not scuff or mar surfaces such as wooden flooring or plastic surfaced flooring on which skating is effected. Notation 87 refers to a recess in the inside surface of the molding 80 to accommodate the screw head or nut retaining the wheel in place.

In FIG. 12, a modified form of the braking means shown in FIGS. 10 and 11 is provided in the form of an assembly 88 of a metal channel support 89 to which is secured a molding 93 of elastomeric or any suitable plastic resin which may be utilized to engage the upper surface of the floor and frictionally decelerate or stop movement of the skate. The channel 89 has an inner side wall 90 which is secured to the side wall of the wheel housing by means of a fastener assembly 81. A recess 94 is provided in the molding 93 to accommodate the head or nut of the fastener assembly 81. The braking member 93 may be adhesively bonded or molded in situ against the inside surface of the channel 89 and has a tapered surface 95 adapted to engage the surface of a floor or other structure on which skating is effected.

FIG. 13 shows a modified form of the skate and braking assembly 96 comprising a molded scuff member 102 secured against the upper side wall portion of the skate assembly 53 by means of a plurality of headed fasteners 81 extending through holes in the upper flange 98 of a retaining member 97 which has a lower portion 101 extending parallel to the side wall of the wheel housing and joined by means of an angularly extending portion 100 to the upper flange portion 98. In other words, the retaining sheet for member 97 serves to compressibly engage the molding 102 against the side wall of the wheel housing 66, as shown in FIG. 13.

The injection moldings 93 and 102 of the embodiments of FIGS. 12 and 13 may be secured to their respective retaining members 89 and 97 by adhesive bonding and/or by deforming portions of the retaining members in a manner to secure them to the moldings. Small fasteners disposed so as not to engage the skating surface may also be employed for securing the plastic moldings to the retaining members. Assembly may also be effected by molding the plastic braking pads in situ against the retaining members.

In order to suitably simulate ice skating and to develop skating skill requisite of ice skating, wheels having diameters in the range of $\frac{3}{4}''$ to $1\frac{1}{2}''$ and thicknesses in the range of $\frac{1}{4}''$ to $\frac{1}{2}'$ are preferably employed for the wheels of the embodiments shown in the drawings. Material of which the peripheral or outer portion of each wheel may be molded or cast include such resins as rubber-like polyurethanes, various fluoroplastics, polybutadiene styrene, ethylene vinyl acetate, polybutylene and polynorbornene while the inside portion of the wheel which is attached to the bearing may be formed of engineering resins such as polycarbonate, polyamide, acetyl, high density polyurethane, polyester and polyvinyl chloride.

In FIGS. 14–16 is shown a modification of the pivot means at the front end of the blade-like assembly and the blade-like assembly itself. Whereas in FIGS. 1–5 the pivot means which comprises an assembly 31 including a dome-shaped plastic member, is slidably secured within a tubular housing 21 which extends along the entire front end of the blade-like assembly 11 and in FIG. 6 the housing for the pivot-means is also an integral portion of the material of the blade-like assembly 53, in FIGS. 14–16 a pivot-means and its housing is formed as a separate assembly which is removably attached to the front end of the blade-like assembly for replacement and maintenance purposes. In FIG. 14 the blade-like assembly 110 is composed of a first assembly 111 of two metal stampings and including laterally extending flange portion 112 extending along both sides of the vertical portion 113 of the blade-like assembly. The lower portion 114 of the vertical portion 113 which is formed of abutting portions of the two stampings comprising the assembly 111, has its two side walls formed with outwardly deformed portions 115 defining wheel pants as described for supporting respective wheels 22 on fasteners or pins 116 in a tandem array beyond the front wheel pant shown.

At the front end 117 of the blade assembly 111 is secured a tubular housing 120 which is preferably a sheet metal stamping or casting supporting an assembly 129 therein, which assembly includes a pivoting member 130 molded of plastic as described and formed with a semi-spherical head 131 at the lower end thereof and a shank portion 132 which is supported for rotation within a bushing 134. A split ring 133 holds the shank portion 132 in rotatable assembly with the bushing and a washer 135 disposed against the upper end face of the bushing.

Housing 120 has a flattened upper portion extending from a lower portion 122 which is a tubular cylindrical shape. The upper portion has a slotted opening in its rear wall to permit it to be slidably assembled to the upper front end 117 of the blade-like support 113 and to extend to the dashed line denoted 117A. Three holes 118 are provided through the end portion 117 of the blade-like support 113 to accomodate three screw fasteners 121 passing through respective holes (not shown) provided in the flattened opposite walls of the upper portion of the tubular housing to secure the housing in assembly with the blade-like assembly 111.

The lower end of the tubular housing 120 is formed with a necked down tubular portion 123 which is gripped and held against the lower end portion 114A by a metal ring-shaped clamp 124 having flat end portions 126 and 127 which engage the opposite surfaces of the lower front end portion 114A of the blade-like support 113 and are fastened thereto by a machine screw 128 and nut, as shown in FIGS. 14 and 16.

Modified forms of the invention include the following:

I. The roller skate structures shown in FIGS. 1 and 6 may be utilized for ice skating by removal of the wheels from their housing supports by removing their supporting shafts or fasteners providing that the lower edging of the stampings forming the blade-like skate assemblies 11 and 50 are properly shaped and ground to permit sliding movement on ice. This would also require removal of the braking assemblies illustrated.

II. If the wheels 22 of the roller skates shown in FIGS. 1 and 6 are removed and replaced with a specially shaped blade having lower edging which is properly shaped for movement on ice and a plurality of upwardly extending finger or lug-like portions which may be disposed and secured with fasteners within the wheel housings 16 and 66 of FIGS. 1 and 6, then such assemblies may be utilized to convert the roller skates to ice skates. The same fasteners employed to hold the wheels in place within the wheel housings may be used to hold such blades in place in place if suitable washers are assembled between the sidewalls of the wheel housings 16 and 66 and the blade portions inserted within such wheel housings to be secured to the blade assemblies.

III. Quick release means may be provided to support the wheels in their housings in the form of spring-loaded pins which are movably secured to the housing walls and either support the respective wheels and bearing or removably support a support for each wheel by securing an extension thereof to the blade-like assembly in a manner such that said wheel support may be removed from the blade assembly by pulling or pushing on the spring-loaded pin.

IV. The skate blade assemblies 11 and 50 of FIGS. 1 and 6 may also be fabricated of unitary steel castings or moldings of plastic or other suitable metal with the wheel housings and the retainers for the pivoting members at the front and rear ends either being formed integral with the casting or molding or attached thereto by the means described.

V. The plurality of separately formed wheel pants or housings denoted 16 and 66 and FIGS. 1 and 6 may be replaced by a single housing extending the lengths of the blade-like assemblies or casting and providing side walls for supporting the three or more wheels and bearings as shown.

VI. The narrow wheels 22 shown in FIGS. 1 and 6 may be replaced by respective plastic balls made of such materials as thermosetting or thermoplastic polyurethane, polycarbonate, nylon or other suitable durable resin retained within special sockets formed of or attached to the side walls of the housings 16 or 66 or a special support for a row of such balls which is attached to the side wall portions of the blade-like assembly, thus permitting sideward movement of the skate as well as forward and backward movement thereof.

I claim:

1. A roller skate comprising:

A skate wheel support having an upper portion including laterally extending flange portions adapted to be secured to the bottom of a shoe, said support having a downwardly extending wheel supporting portion, the lower portion of said wheel supporting portion having a plurality of cowl portions each defined by space-separated outwardly extending and downwardly depending opposite wall portions spaced apart from each other at the bottom of said wheel supporting portion and extending in longitudinal alignment with each other so as to define a plurality of wheel housings, each of which is open at the bottom of said wheel supporting portion of said support, a plurality of wheels extending in a row along the lower portion of said support with each wheel supported in bearing within each of said cowl portions of said support by the opposite walls thereof for supporting and providing wheeled movement of said skate across a surface, and a braking member secured to and supported by the sidewall of said support and having an outer surface of friction producing material which braking member is shaped and positioned to permit said outer surface to be engaged against the surface on which the skate is used to the exclusion of all other portions of said skate for slowing down and stopping movement of the skater along such skating surface.

2. A skate in accordance with claim 1 in which said braking member comprises an assembly of said friction producing material and a support therefor, and means for removably securing said support to said skate.

3. A skate in accordance with claim 1 wherein said braking member extends a sufficient distance along the side wall of said skate support to prevent any other portion of said skate support from engaging the surface on which said skate is used when the foot of the wearer of said skate is disposed at an angle to said skating surface to engage said outer surface of said friction producing material against said skating surface so as to prevent damage to said skating surface.

4. A skate in accordance with claim 3 wherein said braking member comprises an assembly of a base made of metal and a plurality of separate plastic resin members secured to said base and disposed at selected locations along the length of said skate support and means securing said base to said skate support.

5. A skate in accordance with claim 1 wherein said braking member is molded of one of a group of friction producing plastic resins including polyurethane, ethylene vinyl acetate, polybutadiene styrene, ionomer, polybutyl rubber and polynorbornene.

* * * * *